US005954086A

United States Patent [19]

Ronchi

[11] Patent Number: 5,954,086

[45] Date of Patent: Sep. 21, 1999

[54] VALVE WITH CONTROLLED-ACTION OBTURATOR FOR THE METERED DELIVERY OF FLUIDS IN AUTOMATIC MACHINES FOR FILLING CONTAINERS AND THE LIKE

[75] Inventor: Mario Ronchi, Cologno Monzese, Italy

[73] Assignee: Ronchi Mario S.R.L., Cessate, Italy

[21] Appl. No.: 08/995,835

[22] Filed: Dec. 22, 1997

[30] Foreign Application Priority Data

Dec. 23, 1996 [IT] Italy ..... MI96A2730

[51] Int. Cl.[6] ..... B08B 9/00; F16K 31/122

[52] U.S. Cl. ..... 137/244; 251/63.5; 251/335.2; 222/149; 222/504

[58] Field of Search ..... 251/63.5, 335.2, 251/63, 61; 137/244; 222/148, 559, 149; 337/504

[56] References Cited

U.S. PATENT DOCUMENTS

| | | | |
|---|---|---|---|
| 1,507,139 | 9/1924 | Pike | 137/244 |
| 3,517,688 | 6/1970 | Scholle . | |
| 4,644,969 | 2/1987 | Watanabe | 251/335.2 |
| 4,815,692 | 3/1989 | Loiseau et al. | 251/63.5 |

FOREIGN PATENT DOCUMENTS

| | | |
|---|---|---|
| 0 095 651 | 12/1983 | European Pat. Off. . |
| 0 197 575 | 10/1986 | European Pat. Off. . |
| 0 402 535 | 12/1990 | European Pat. Off. . |
| 2 625 993 | 7/1989 | France . |
| 25 39 656 | 3/1977 | Germany . |

*Primary Examiner*—George L. Walton
*Assistant Examiner*—Bryan C. Wallace
*Attorney, Agent, or Firm*—Herbert Dubno

[57] ABSTRACT

A valve for the metered delivery of fluids to be supplied to containers and the like, comprising a body and a closing cover inside which there is formed a chamber which is supplied with the fluid to be delivered to the container and provided with an obturator which is integral with the rod of a piston of a cylinder inside the body of the valve and can be operated in both directions for opening/closing of an aperture for communication with the outside of said chamber, there also being provided an outlet; for delivery of the fluid, which is mounted on the valve coaxially with the aperture thereof.

5 Claims, 3 Drawing Sheets

VALVE WITH CONTROLLED-ACTION OBTURATOR FOR THE METERED DELIVERY OF FLUIDS IN AUTOMATIC MACHINES FOR FILLING CONTAINERS AND THE LIKE

FIELD OF THE INVENTION

My present invention relates to a valve with a controlled-action obturator or the invention for the metered delivery of fluids under pressure, in automatic machines for filling containers and the like.

BACKGROUND OF THE INVENTION

It is known in the technical sector relating to automatic filling of containers of various types, size and shape, automatic filling machines are used, which are able to deliver, by means of controlled valves associated with delivery outlets, a predetermined metered quantity of the fluid to be supplied to the empty container conveyed opposite said outlet by conveying means of various types.

It is also known that the fluids to be supplied to the containers to be filled may have physical and chemical characteristics which are very different from one another the such as to determine the need for providing special valve/outlet unit for each type of fluid.

For example, in the case of liquid, viscous and foam-producing products, it is necessary to provide outlets which have a wide delivery nozzle and inside which there must be inserted a flow reducer, in order to slow down the delivery and prevent generation of foam, and a jet-breaking screen for retaining the droplets of product and preventing them from falling droplets between advance feeding of the filled container and arrival of the next empty container.

In the case of viscous products, on the other hand, the outlet must have a delivery nozzle which is narrow, but provided with a strand-breaking element which prevents the strand of product which is left hanging from the outlet at the end of each delivery operation from being dragged between one container and the next one.

In addition to the outlets of the known type there is the problem arising from the need to interrupt the supply, under pressure, of the product to the machine so as to be able to perform change-over of the outlet itself when there is a variation in the type of product, without causing losses of the latter.

OBJECT OF THE INVENTION

It is an object of the invention therefore, to provide a fluid delivery device for automatic filling machines which is able to function in a precise and repeatable manner with any type of fluid, allows the type of delivery outlet to be easily changed depending on the specific fluid, and can be operated and controlled by means of automatic programming and control apparatus.

A further object is to provide such a device which is easy and inexpensive to install on machines of the known type as well as easy to wash and sterilize internally for the delivery of food products and the like.

SUMMARY OF THE INVENTION

These object are attained according to the present invention with a valve for the metered delivery of fluids to be supplied to containers and the like, comprising a body and a closing cover inside which there is formed a chamber which is supplied with the fluid to be delivered to the container, the valve comprising an obturator which is integral with the rod of a piston of a cylinder inside the body of the valve and can be operated in both directions for opening/closing of an aperture for communication with the outside of said chamber, there also being provided an outlet for delivery of the fluid, which is mounted on said valve coaxially with said aperture thereof.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
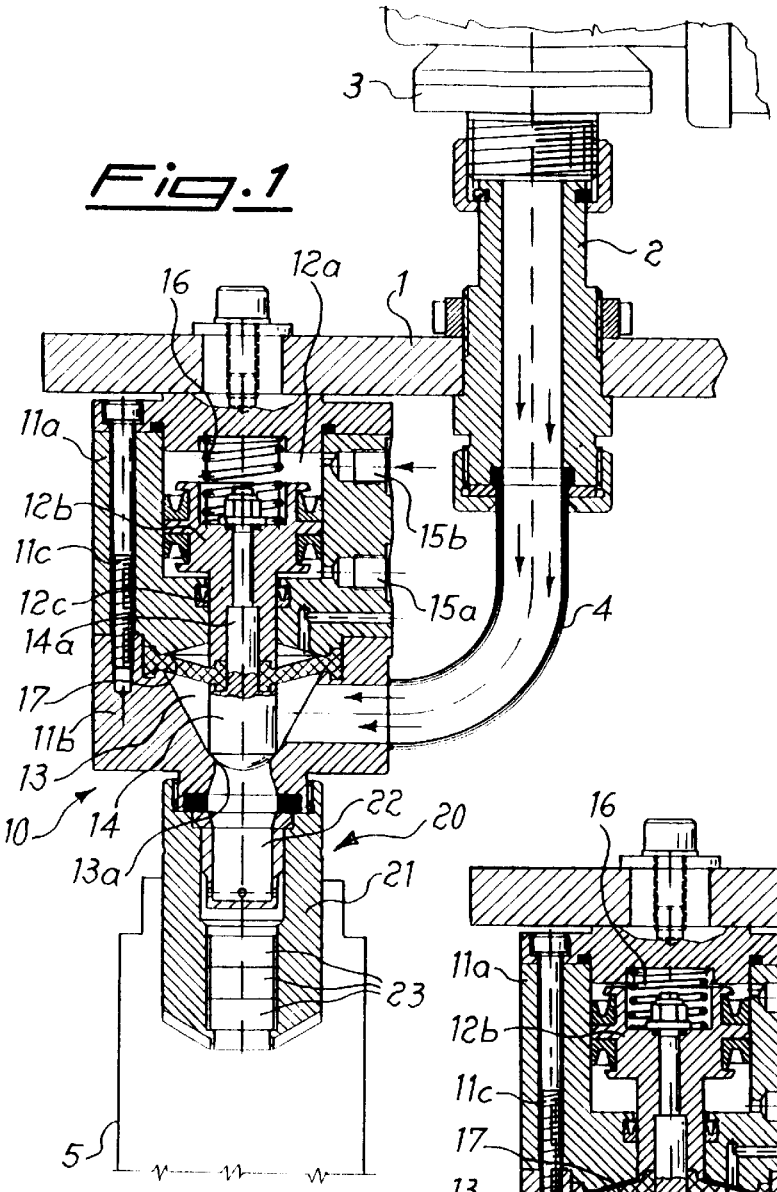
FIG. 1 is a schematic view, in longitudinal section, of a first embodiment of the valve according to the invention in the closed position.
Figure 2:
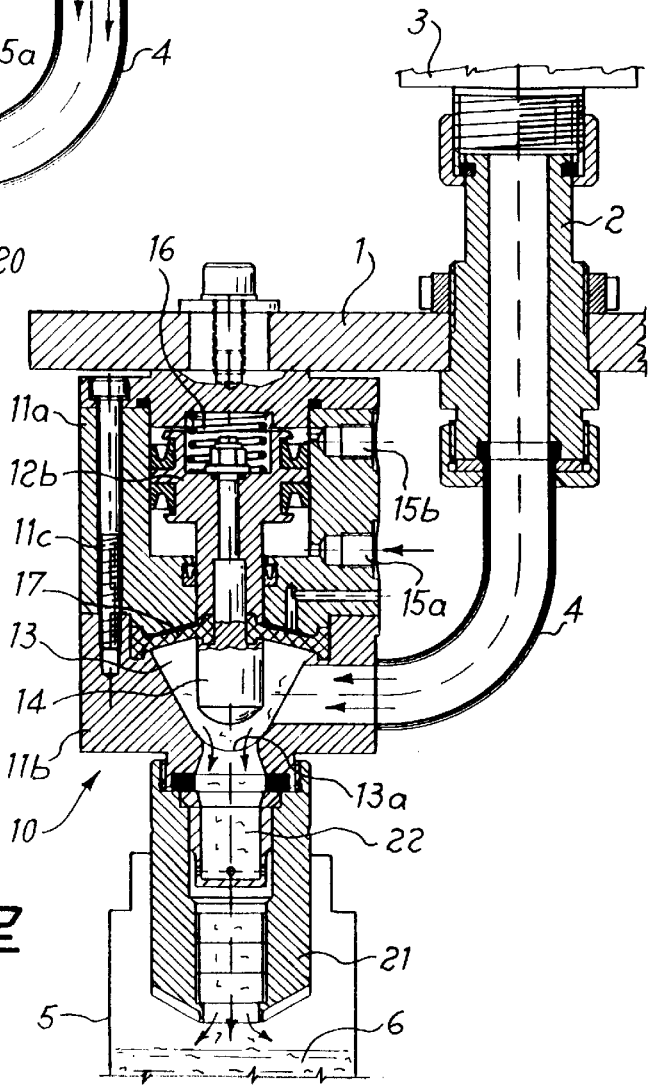
FIG. 2 is a section as in FIG. 1 with the valve open for delivery.

As illustrated in FIG. 1, the valve 10 according to the invention is mounted on an automatic filling machine schematically indicated by means of a disc 1 to which the valve itself is rigidly attached, as well as a connection-piece 2 designed to be connected at the top to the network 3 for distribution of the fluid to be delivered and at the bottom to the duct 4 supplying the fluid itself to the valve 10.

The valve 10 is composed essentially of an upper body 11*a* and a bottom cover 11*b* which are joined together by means of screws 11*c* or the like.

The upper body 11*a* has a coaxial cavity forming a cylinder 12*a* with, sliding inside it, a piston 12*b*, the rod 12*c* of which extends towards the inside of the bottom cover 11*b* of the valve. The piston 12*b* may be actuated in both directions by means of associated supply sources 15*a*,15*b* for fluid under pressure, raising of the piston 12*b* occurring against the thrusting action of a safety spring 16 which keeps the valve normally closed.

The cover 11*b* has, formed inside it, a cavity 13 which opens outwards by means of an aperture 13a emerging in the delivery outlet 20 described in detail below.

The stem 14*a* of an obturator 14 which is designed to open/close the said delivery aperture 13*a* is inserted in the rod 12*c* of the piston, which is internally hollow.

The valve also has, arranged inside it, a sealing membrane 17 through which the obturator 14 passes and which is necessary for keeping the fluid isolated from the outside, as is required in the case of a food or pharmaceutical product.

Finally, an outlet 20 suitable for the particular type of fluid to be delivered to the container may be mounted on the valve 10 according to the invention.

In the case of FIG. 1, for example, the outlet 20 has a cylindrical body 21 with a wide diameter having, arranged inside it, a flow reducer 22 and a series of jet-breaking screens 23, as required in the case of a foam-producing product.

The valve operates in the following manner:

When the valve is in the closed condition (FIG. 1), the piston 12*b* is supplied under pressure by means of the supply source 15*b*, causing at the same time discharging of the supply source 15*a*, so as push the obturator 14 downwards and close the delivery aperture 13*a*; in this way the fluid supplied through the duct 4 of the filling machine is blocked under pressure inside the chamber 13 of the cover 11*b* of the valve.

When the machine control program authorises delivery, the cylinder 12*a* is supplied by means of the supply source 15*a* and the inlet 15*b* is discharged, thus causing the obturator 14 to move up again, thereby opening the aperture 13*a* of the valve, allowing the fluid present in the chamber 13 to flow out.

The fluid, passing through the special outlet 20, enters into the container 5 without generating foam and, when the control program has detected delivery of the correct metered amount, supplying and discharging of the supply sources 15*a*,15*b* is reversed, causing the downward movement of the obturator 14 and consequent closing of the valve.

Figure 3:
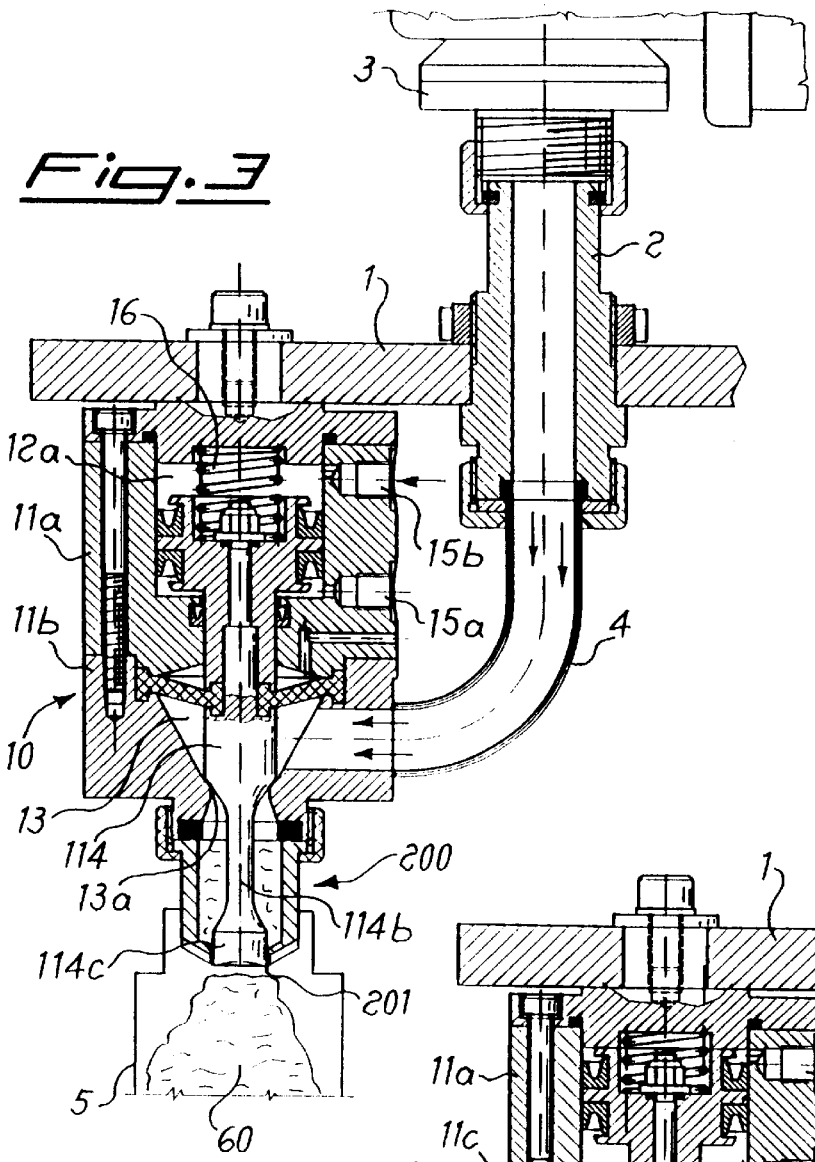
FIG. 3 is a schematic view, in longitudinal section, of a second embodiment of the valve according to the invention in the closed position.

FIG. 3 shows a variation of embodiment of the valve according to the invention, which is particularly suitable for the delivery of fluids of the dense and viscous type, which require a simultaneous action involving interruption in the delivery and cutting of the strand of product at the delivery outlet so as to avoid the product itself being dragged along.

As shown, the obturator 114 of the valve 10 is prolonged axially downwards by means of a shank 114*a* terminating in a truncated head 114*c* which has a diameter slightly smaller than the nozzle or opening 201 of the outlet 200 mounted on the valve.

In this case the outlet 200 does not require any further internal elements, a narrow diameter thereof being sufficient.

Figure 4:
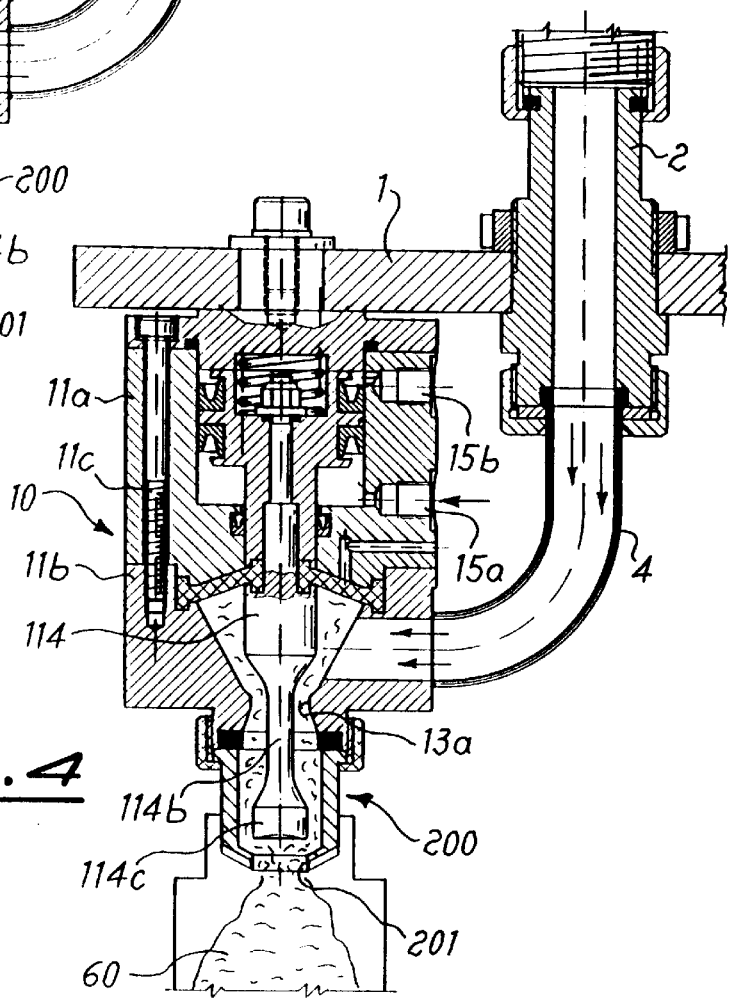
FIG. 4 is a section as in FIG. 3 with the valve open for delivery.

As can be seen from FIGS. 3 and 4, operation of the valve is entirely similar to that of the valve according to FIG. 1. In this case, however, the downward movement of the obturator 114 causes the simultaneous closure of the aperture 13*a* and, by means of the head 114*b* which penetrates into the nozzle 201, cutting of the strand of delivered product 60.

Figure 5:
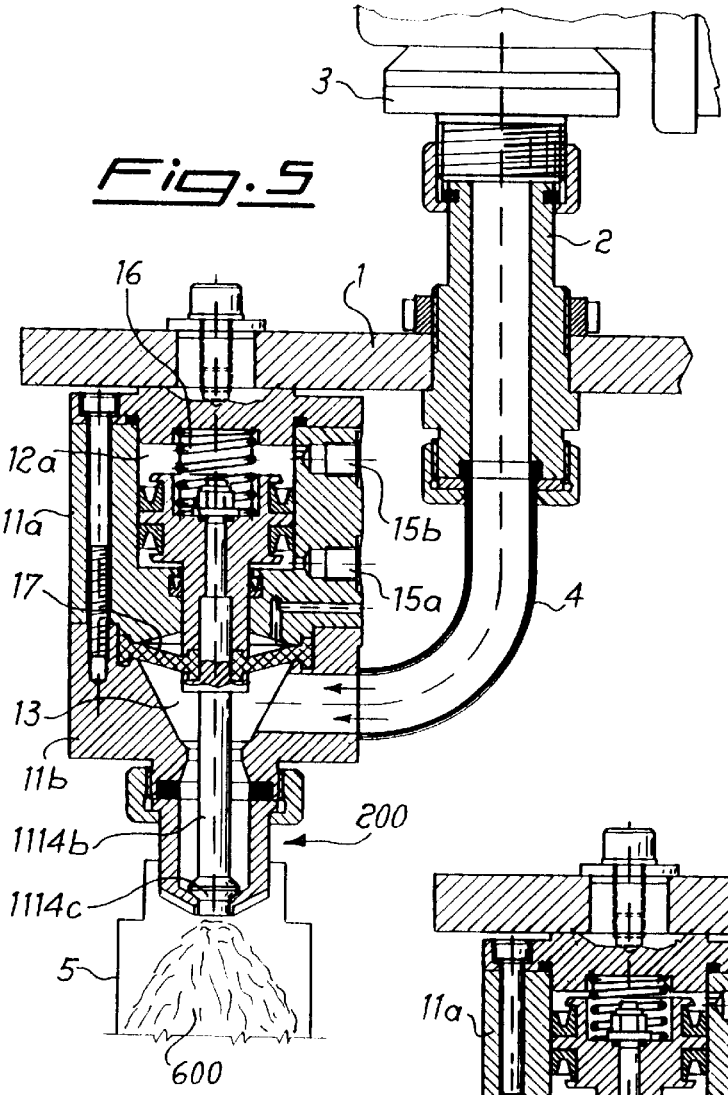
FIG. 5 is a schematic view, in longitudinal section, of a third embodiment of the valve according to the invention in the closed position.
Figure 6:
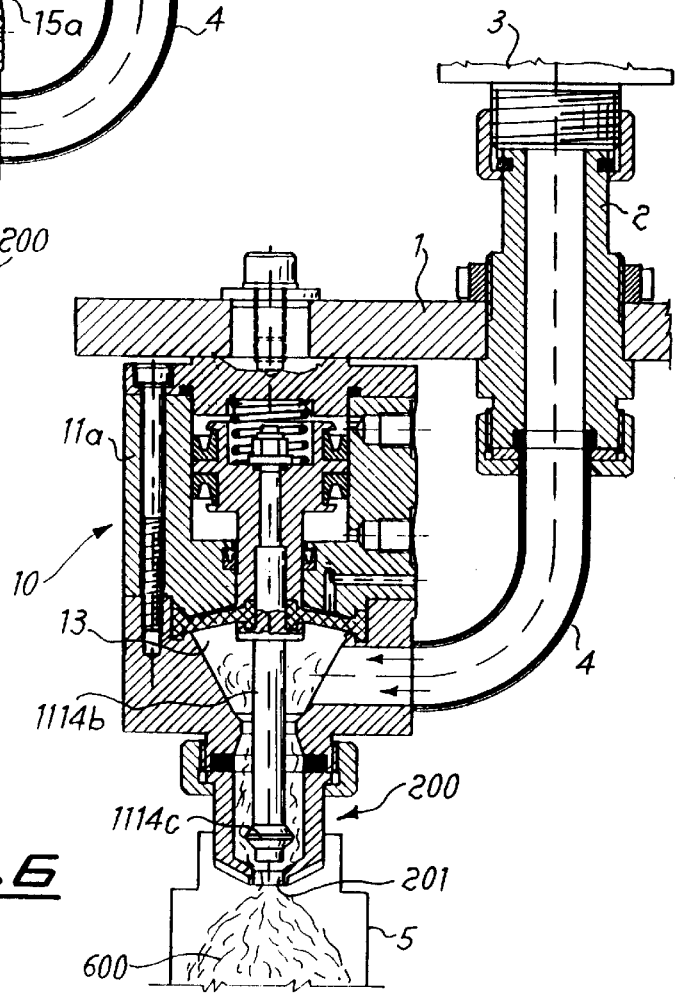
FIG. 6 is a section as in FIG. 5 with the valve open for delivery.

FIGS. 5 and 6 show a further example of embodiment of the valve according to the invention, which is particularly suitable for dense and stringy products: in this case the obturator consists of a cylindrical rod 1114*b*, which is substantially cylindrical and the free end of which has a head 1114*c* which is designed to perform both sealing and cutting of the strand of product 600 supplied to the container 5, at the moment when delivery is interrupted.

Operation of the valve also remains unchanged in this case.

It is therefore obvious how the obturator valve according to the invention allows the fluid which is to be supplied to the filling container, to be regulated in an extremely precise and reliable manner, said valve, moreover, being able to be adapted in an extremely simple manner to the particular physical and chemical characteristics of the product to be delivered owing to the ease of interchangeability of the obturator.

I claim:

1. A valve selectively dispensing a flowable material into a succession of containers as said containers are selectively moved past said valve, said valve comprising:

a vertically oriented valve body formed with a cylinder provided with a downwardly extending passage;

a cover affixed to said cylinder at a bottom thereof and having a chamber communicating with said passage, an inlet for a flowable material to be dispensed opening laterally in said chamber, and an aperture for discharging material from said chamber axially aligned with said passage;

a piston displaceable in said cylinder and having a stem slidably extending through said passage;

an obturator replaceably affixed to said stem, extending through said chamber and adapted to seat on said cover to block said aperture, said obturator having an extension coaxial with said obturator and passing with clearance through said aperture, said extension having a cylindrical head below said aperture; and an outlet detachably and sealably affixed to said cover and surrounding at least a major portion of said extension and said head and formed with a nozzle for said flowable material spaced from the seat and cooperating with said head to block outflow of said flowable material from said nozzle in a closed position of said obturator, said nozzle and said head being shaped to sever a strand of a delivered product emerging from said nozzle and to seal said nozzle when delivery via said nozzle is blocked during movement of said obturator into said closed position.

2. The valve defined in claim 1, further comprising a spring acting upon said piston and compressible upon displacement of said obturator away from said seat.

3. The valve defined in claim 1 wherein said nozzle includes a cylindrical sleeve surrounding said extension with clearance and having an inwardly converging end formed with said outlet.

4. The valve defined in claim 1 wherein said chamber converges toward said outlet.

5. The valve defined in claim 1, further comprising a sealing membrane engaged between said obturator and said piston and between said cover and said cylinder.

* * * * *